United States Patent [19]

Gartner

[11] Patent Number: 4,531,332

[45] Date of Patent: Jul. 30, 1985

[54] ROOFTOP PARAPET FOR THERMALLY-INSULATED CURTAIN WALL

[75] Inventor: Karl Gartner, Gundelfingen, Fed. Rep. of Germany

[73] Assignee: Yoshida Kogyo K. K., Tokyo, Japan

[21] Appl. No.: 515,495

[22] Filed: Jul. 20, 1983

[30] Foreign Application Priority Data

Jul. 21, 1982 [JP] Japan ..... 57-110379[U]

[51] Int. Cl.[3] ..... E04H 1/00

[52] U.S. Cl. ..... 52/58; 52/235; 52/300; 52/573

[58] Field of Search ..... 52/57–62, 52/235, 236.3, 300, 345, 346, 347, 483, 573

[56] References Cited

U.S. PATENT DOCUMENTS

| | | | |
|---|---|---|---|
| 3,312,585 | 4/1967 | Hamme | 52/309.13 |
| 3,425,172 | 2/1969 | Attaway | 52/58 |
| 3,447,273 | 6/1969 | Thom | 52/58 |
| 3,509,672 | 5/1970 | Brooks | 52/235 |
| 3,702,045 | 11/1972 | Selvaag | 52/58 |
| 3,786,604 | 1/1974 | Kramer | 52/573 |
| 4,021,987 | 5/1977 | Schnebel et al. | 52/235 |
| 4,449,341 | 5/1984 | Taglianetti et al. | 52/235 |
| 4,450,659 | 5/1984 | Hanaoka et al. | 52/235 |

*Primary Examiner*—John E. Murtagh
*Assistant Examiner*—Andrew Joseph Rudy
*Attorney, Agent, or Firm*—Hill, Van Santen, Steadman & Simpson

[57] ABSTRACT

A rooftop parapet, for a thermally-insulated-curtain-walled building, comprises: a parapet base; a thermally-insulated curtain wall having an upper part spaced apart from the parapet base with a gap therebetween; a moisture-proof sheet covering the gap; a thermally insulating material laid over an upper edge of the parapet base, the moisture-proof sheet, and an upper edge of the curtain wall; a waterproof sheet superposed over the insulating material; and a coping plate superposed over the waterproof sheet. Either the moisture-proof sheet or the waterproof sheet has a sagged portion so that the coping plate can follow the deflection of the curtain wall's upper part due to wind pressure acting on the curtain wall. The moisture-proof sheet serves to prevent the thermally insulating material from absorbing moisture inside the building, while the waterproof sheet serves to prevent dewdrops on an inner face of the coping plate from coming down to the insulating material.

6 Claims, 3 Drawing Figures

ROOFTOP PARAPET FOR THERMALLY-INSULATED CURTAIN WALL

BACKGROUND OF THE INVENTION

1. Field of the Invention

The present invention relates to a rooftop parapet for a building in which a plurality of thermally-insulated curtain walls is used to cover exterior building walls.

2. Prior Art

In modern buildings, curtain walls are widely used, partly because they enable a substantially reduced term of construction and partly because they make the building very neat in appearance.

As exemplified by FIG. 1 of the accompanying drawings, most curtain walls 1, each including a panel usually made of metal such as stainless steel, are secured to a building framework 2 by a plurality of fasteners 3 so as to be spaced apart facewise from the building framework 2. The uppermost curtain wall 1 has an upper part 1*a* which is spaced apart from a parapet base 4 with a gap s therebetween; a coping plate 5 is laid over an upper edge of the uppermost curtain wall 1, the gap s, and an upper edge of the parapet base 4. Because of this structural characteristic, the individual curtain wall 1 tends to become inwardly curved in its middle between the fasteners 3 when wind pressure acts on the curtain wall 1 (from outside), as shown in FIG. 2. At that time the upper part 1*a* of the uppermost curtain wall 1 is thus appreciably deflected away from the parapet base 4, widening the gap s. Consequently, the mounting of the coping plate 5 must be such that the coping plate 5 follows or allows such deflection of the upper part 1*a* of the uppermost curtain wall 1.

To effect a thermal insulation in such a rooftop parapet, it is known to place a thermally insulating material between the coping plate 5 and an upper edge of the parapet base 4, the curtain walls being thermally insulated. However, this thermally insulating material serves as an absorber of moisture inside the building, thus causing a sharply reduced degree of thermal insulation.

SUMMARY OF THE INVENTION

According to the present invention, a rooftop parapet, for a thermally-insulated-curtain-walled building, comprises: a parapet base; a thermally-insulated curtain wall having an upper part spaced apart from the parapet base with a gap therebetween; a moisture-proof sheet covering the gap; a thermally insulating material laid over an upper edge of the parapet base, the moisture-roof sheet, and an upper edge of the curtain wall; a waterproof sheet superposed over the insulating material; and a coping plate superposed over the waterproof sheet. Either the moisture-proof sheet or the waterproof sheet has a sagged portion so that the coping plate can follow the deflection of the curtain wall's upper part due to wind pressure acting on the curtain wall. The moisture-proof sheet serves to prevent the thermally insulating material from absorbing moisture inside the building. The waterproof sheet serves to prevent dewdrops on an inner face of the coping plate from coming down to the insulating material.

It is therefore an object of the invention to provide a rooftop parapet, for a thermally-insulated-curtain-walled building, which parapet guarantees an adequate degree of thermal insulation.

Another object of the invention is to provide a rooftop parapet, for a thermally-insulated-curtain-walled building, which parapet allows an upper part of the uppermost curtain wall to be deflected due to wind pressure.

Many other advantages, features and additional objects of the present invention will become manfiest to those versed in the art upon making reference to the detailed description and the accompanying drawings in which a preferred embodiment incorporating the principles of the present invention is shown by way of illustrative example.

DETAILED DESCRIPTION

Figure 1:
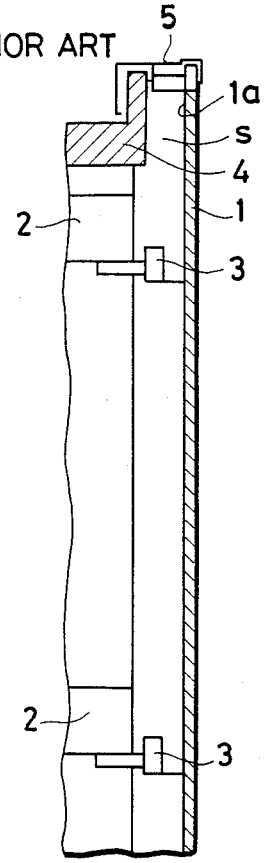
FIG. 1 PRIOR ART
FIGS. 1 and 2 are schematic vertical cross-sectional views of a part of a curtain-walled building, illustrating a prior art problem.
Figure 2:
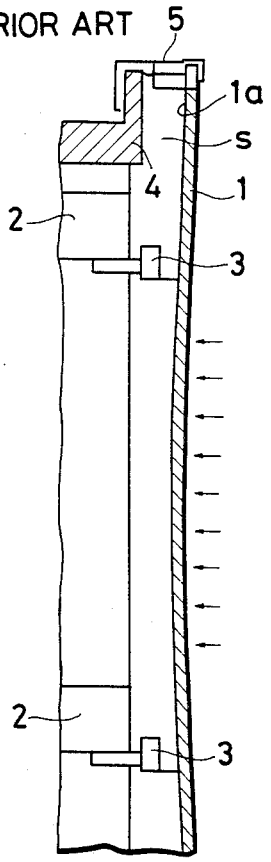
FIG. 2 PRIOR ART
Figure 3:
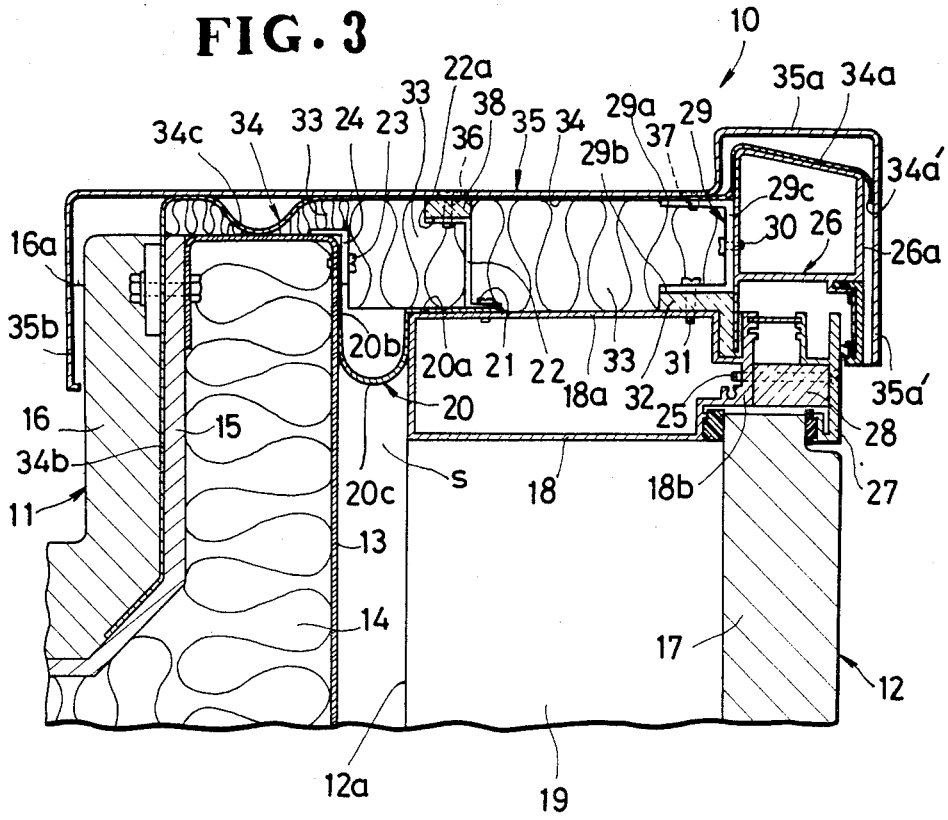
FIG. 3 is a vertical cross-sectional view of a rooftop parapet, for a curtain-walled building, embodying the present invention.

The principles of the present invention are particularly useful when embodied in a rooftop parapet such as shown in FIG. 3, generally indicated by the numeral 10. The rooftop parapet 10 is suitable for a curtain-walled building.

The rooftop parapet 10 generally comprises a parapet base 11 disposed on an edge of the building's uppermost slab, and an uppermost curtain wall 12 which is thermally insulated and which is secured to a building framework (not shown) by a plurality of fasteners (not shown) so as to be spaced apart from the building framework. Thus an upper part 12*a* of the uppermost curtain wall 12 is spaced apart from the parapet base 11 with a predetermined gap s therebetween, which gap opens to the air inside the building.

The parapet base 11 includes, from the exterior side (right side in FIG. 3), an iron plate 13, a layer of thermally insulating material 14, a layer of waterproof material 15, and a layer of mortar 16.

The curtain wall 12 comprises a rectangular frame and a panel 17 mounted on the frame at its exterior side (right side in FIG. 3). The rectangular frame includes a pair of upper and lower horizontal frame members 18, 18 (only upper horizontal frame member is shown for clarity) of hollow cross section, and a pair of vertical frame members 19, 19 (only one vertical frame member is shown for clarity) of hollow cross section connected to the upper and lower horizontal frame members 18, 18 at their ends. The panel 17 is preferably filled with a thermally insulating material (not shown).

The gap s between the parapet base 11 and the upper part 12*a* of the uppermost curtain wall 12 is covered at its upper side by an elongated moisture-proof sheet 20 which is made of metal, plastic or rubber. The moisture-proof sheet 20 is secured at one or exterior longitudinal margin 20*a* to the upper horizontal frame member 18 by a plurality of screws 21 (only one screw is shown) each extending through a bracket 22, the moisture-proof sheet 20, and an upper plate 18*a* of the upper horizontal frame member 18. Likewise, the other or interior longitudinal margin 20*b* of the moisture-proof sheet 20 is secured to the parapet base 11 by a plurality of screws 23 (only one screw is shown) each extending through a bracket 24, the moisture-proof sheet 20, and the iron plate 13. The moisture-proof sheet 20 is downwardly sagged in its middle 20*c* along its entire length, for a purpose described below.

An elongated hollow support member 26 is mounted on the upper and exterior edge of the uppermost curtain wall 12, for a purpose described below. Disposed between the support member 26 and the panel 17 is a batten 27 which is secured to the upper horizontal frame member 18 by a plurality of screws 25 (only one screw is shown) each extending through the batten 27, a thermally insulating material 28, and an exterior plate 18*b* of the upper horizontal frame member 18. The support member 26 is connected to the upper horizontal frame member 18 via a plurality of brackets 29 (only one bracket is shown) of generally reversed C-shaped cross section; each bracket 29 thus has upper and lower horizontal plates 29*a*, 29*b* and a vertical plate 29*c* extending therebetween. The support member 26 is secured to the vertical plate 29*c* by a screw 30, and the lower horizontal plate 29*b* in turn is secured to the upper horizontal frame member 18 by a screw 31 extending through the lower horizontal plate 29*b*, a thermally insulating material 32, and the upper plate 18*a* of the upper horizontal frame member 18.

A thermally insulating material 33 is laid over an upper edge of the parapet base 11, the gap s, and the upper horizontal frame member 18. A waterproof sheet 34, which is made of metal, plastic or rubber, is superposed over the thermal insulating material 33. One or exterior margin 34*a* of the waterproof sheet 34 extends on and across an upper plate of the support member 26 and terminates in a hanging edge 34*a*'. At the other or interior margin 34*b*, the waterproof sheet 34 penetrates deeply into the parapet base 11 between the waterproof material layer 15 and the mortar layer 16. The waterproof sheet 34 has a downwardly sagged portion 34*c* extending longitudinally along the upper edge of the parapet base 11, for a purpose described below.

In addition, a capping or coping plate 35, which is preferably made of metal, is superposed over the waterproof sheet 34. One or exterior margin 35*a* of the coping plate 35 extends over and about the support member 26 and terminates in a vertical edge 35*a*' which is spaced apart from an exterior plate 26*a* of the support member 26 by a predetermined distance for a purpose described below. At the other or interior margin 35*b*, the coping plate 35 extends over the upper edge of the parapet base 11 and terminates in a vertical edge 35*b* which is spaced apart from an interior face 16*a* of the mortar layer 16 by a predetermined distance for a purpose described below. The coping plate 35 is secured not only to the brackets 22 by a plurality of screws 36 (only one screw is shown) but also to the brackets 29 by a plurality of screws 37 (only one screw is shown). Each of the screws 36 extends through the coping plate 35, the waterproof sheet 34, a thermally insulating material 38, and an upper plate 22*a* of the respective bracket 22. On the other hand, each of the screws 37 extends through the coping plate 35, the waterproof sheet 34, and the upper plate 29*a* of the respective bracket 29.

In the rooftop parapet 10, the coping plate 35 can freely follow the deflection of the uppermost curtain wall's upper part 12*a* due to wind pressure acting on the curtain wall 12, partly because the coping plate 35 is fixed to the upper horizontal frame member 18 and is not fixed to the parapet base 11 and partly because either the moisure-proof sheet 20 or the waterproof sheet 34 has the sagged portion 20*c*, 34*c*, respectively.

Another advantage of the rooftop parapet 10 is that the moisture-proof sheet 20 serves to prevent the thermally insulating material 33 from absorbing moisture inside the building, while the waterproof sheet 34 serves to prevent dewdrops on an inner face of the coping plate 35 from coming down to the insulating material 33, thus jointly maintaining an adequate degree of thermal insulation. The waterproof sheet 34 also serves to prevent water, penetrated through the joint of adjacent segments of the coping plate 35, from coming into the insulating material 33.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A rooftop parapet for a thermally-insulated-curtain-walled building, comprising:

(a) a parapet base;

(b) a thermally-insulated curtain wall having an upper part spaced apart from said parapet base with a gap therebetween;

(c) a moisture-proof sheet covering said gap;

(d) a thermally insulating material laid over an upper edge of said parapet base, said moisture-proof sheet, and an upper edge of said curtain wall;

(e) a waterproof sheet superposed over said insulating material; and (f) a coping plate superposed over said waterproof sheet.

2. A rooftop parapet according to claim 1, said moisture-proof sheet having a sagged portion.

3. A rooftop parapet according to claim 1, said waterproof sheet having a sagged portion.

4. A rooftop parapet according to claim 1, said coping plate being spaced from said parapet base and secured to said curtain wall.

5. A rooftop parapet according to claim 2, said sheet being secured to said parapet base and also to said curtain wall respectively at opposite sides of said sagged portion.

6. A rooftop parapet according to claim 3, said sheet being secured to said parapet base and also to said curtain wall respectively at opposite sides of said sagged portion.

* * * * *